US006895935B2

(12) United States Patent
Braun et al.

(10) Patent No.: US 6,895,935 B2
(45) Date of Patent: May 24, 2005

(54) FUEL INJECTION DEVICE COMPRISING A PRESSURE AMPLIFIER

(75) Inventors: Wolfgang Braun, Ditzingen (DE); Bernd Mahr, Plochingen (DE); Martin Kropp, Tamm (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/343,217

(22) PCT Filed: May 18, 2002

(86) PCT No.: PCT/DE02/01801

§ 371 (c)(1),
(2), (4) Date: Jun. 20, 2003

(87) PCT Pub. No.: WO02/099268

PCT Pub. Date: Dec. 12, 2002

(65) Prior Publication Data

US 2004/0020464 A1 Feb. 5, 2004

(30) Foreign Application Priority Data

Jun. 1, 2001 (DE) ..... 101 26 685

(51) Int. Cl.[7] ..... F02M 33/04
(52) U.S. Cl. ..... 123/446; 123/496
(58) Field of Search ..... 123/446–447, 123/467, 496

(56) References Cited

U.S. PATENT DOCUMENTS

| | | | | | |
|---|---|---|---|---|---|
| 3,893,629 | A | * | 7/1975 | Okamoto | 239/88 |
| 4,372,272 | A | * | 2/1983 | Walter et al. | 123/467 |
| 5,622,152 | A | * | 4/1997 | Ishida | 123/446 |
| 6,293,252 | B1 | * | 9/2001 | Niethammer et al. | 123/447 |
| 6,446,603 | B1 | * | 9/2002 | Bonse et al. | 123/446 |
| 6,604,507 | B1 | * | 8/2003 | Lei et al. | 123/446 |

FOREIGN PATENT DOCUMENTS

| | | | |
|---|---|---|---|
| DE | 19848904 | * | 4/2000 |
| DE | 19910970 | * | 9/2000 |
| DE | 19949848 | * | 4/2001 |

* cited by examiner

*Primary Examiner*—Thomas Moulis
(74) *Attorney, Agent, or Firm*—Ronald E. Greigg

(57) ABSTRACT

A fuel injection system includes a pressure booster having a displaceable piston which can be subjected to pressure via a pressure booster chamber on the low-pressure side for compressing the fuel in a pressure booster chamber on the high-pressure side to be delivered to an injector. The stroke of the piston is controllable by the pressure in a differential chamber of the pressure booster and is used to vary the fuel pressure delivered to the injector. Means for continuously variable definition of the inlet cross section to the pressure booster chamber of the pressure booster on the low-pressure side or of the outlet cross section from the differential chamber of the pressure booster are provided.

4 Claims, 2 Drawing Sheets

FUEL INJECTION DEVICE COMPRISING A PRESSURE AMPLIFIER

CROSS-REFERENCE TO RELATED APPLICATIONS

This application is a 35 USC 371 application of PCT/DE 02/01801 filed on May 18, 2002.

BACKGROUND OF THE INVENTION

1. Field of the Invention

The invention relates to an improved fuel injection system, including a pressure booster, for use in an internal combustion engine.

2. Description of the Prior Art

For better comprehension of the description and claims, some terms will now be defined: The fuel injection system of the invention can be embodied as either stroke-controlled or pressure-controlled. Within the scope of the invention, a stroke-controlled fuel injection system is to be understood to mean that the opening and closing of the injection opening with the aid of a displaceable nozzle needle is effected on the basis of the hydraulic cooperation of the fuel pressures in a nozzle chamber and in a control chamber. A pressure reduction inside the control chamber causes a stroke of the nozzle needle. Alternatively, the deflection of the nozzle needle can be effected by means of a final control element (actuator). In a pressure-controlled fuel injection system according to the invention, the nozzle needle is moved by the fuel pressure, prevailing in the nozzle chamber of an injector, counter to the action of a closing force (spring), so that the injection opening is opened for an injection of the fuel from the nozzle chamber into the cylinder. The pressure at which fuel emerges from the nozzle chamber into a cylinder of an internal combustion engine is called the infection pressure, while the term system pressure is understood to mean the pressure at which fuel is available or kept on hand inside the fuel injection system. Fuel metering means furnishing a defined fuel quantity for injection. The term leakage, or leak fuel, is understood to mean a quantity of fuel that occurs in operation of the fuel injection system (such as a guide leakage) but is not used for injection and so is returned to the fuel tank. The pressure level of this leak fuel can be a static or fixed pressure, after which the fuel is depressurized to the pressure level of the fuel tank.

Many engine manufacturers require a shallow leading edge of the pressure at the onset of the injection. Often, a boot phase is also desired in order to lower emissions. In fuel injection systems with a pressure booster, of the kind known for instance from German Patent Disclosure DE-A1-19910970, the pressure booster can be used to shape the course of injection. Thus the desired injection course can be achieved without such additional parts as deflection pistons. To vary the pressure course, the motion of the piston of the pressure booster can be used. Varying the inlet cross section to the pressure booster chamber on the low-pressure side as a function of pressure is known from U.S. Pat. No. 5,868,317. That US patent proposes controlling the inlet cross section in multiple stages.

SUMMARY OF THE INVENTION

The present invention enables varying the fuel pressure during the injection and achieving a flat pressure increase without interfering pressure fluctuations. As the piston stroke increases, a greater cross section is opened and thus a greater injection quantity is made possible, so that continuously variable shaping of the injection course is possible.

BRIEF DESCRIPTION OF THE DRAWINGS

Two exemplary embodiments of the fuel injection system of the invention are described herein below, with reference to the drawings, in which.

DESCRIPTION OF THE PREFERRED EMBODIMENTS

Figure 1:
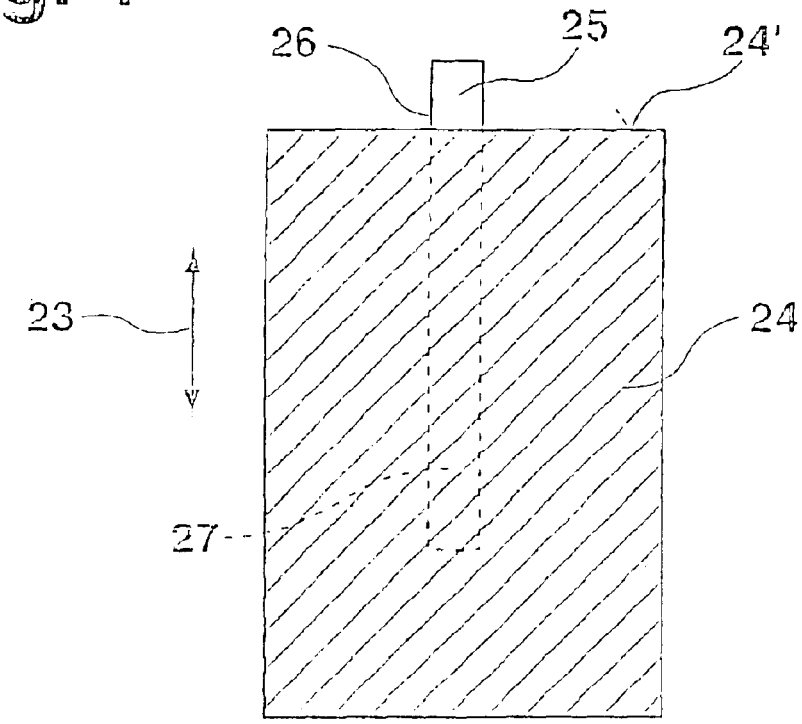
FIG. 1 is a first continuously variable change in cross section of the inlet to or outlet from a chamber of a pressure booster in a fuel injection system according to the invention.
Figure 3:
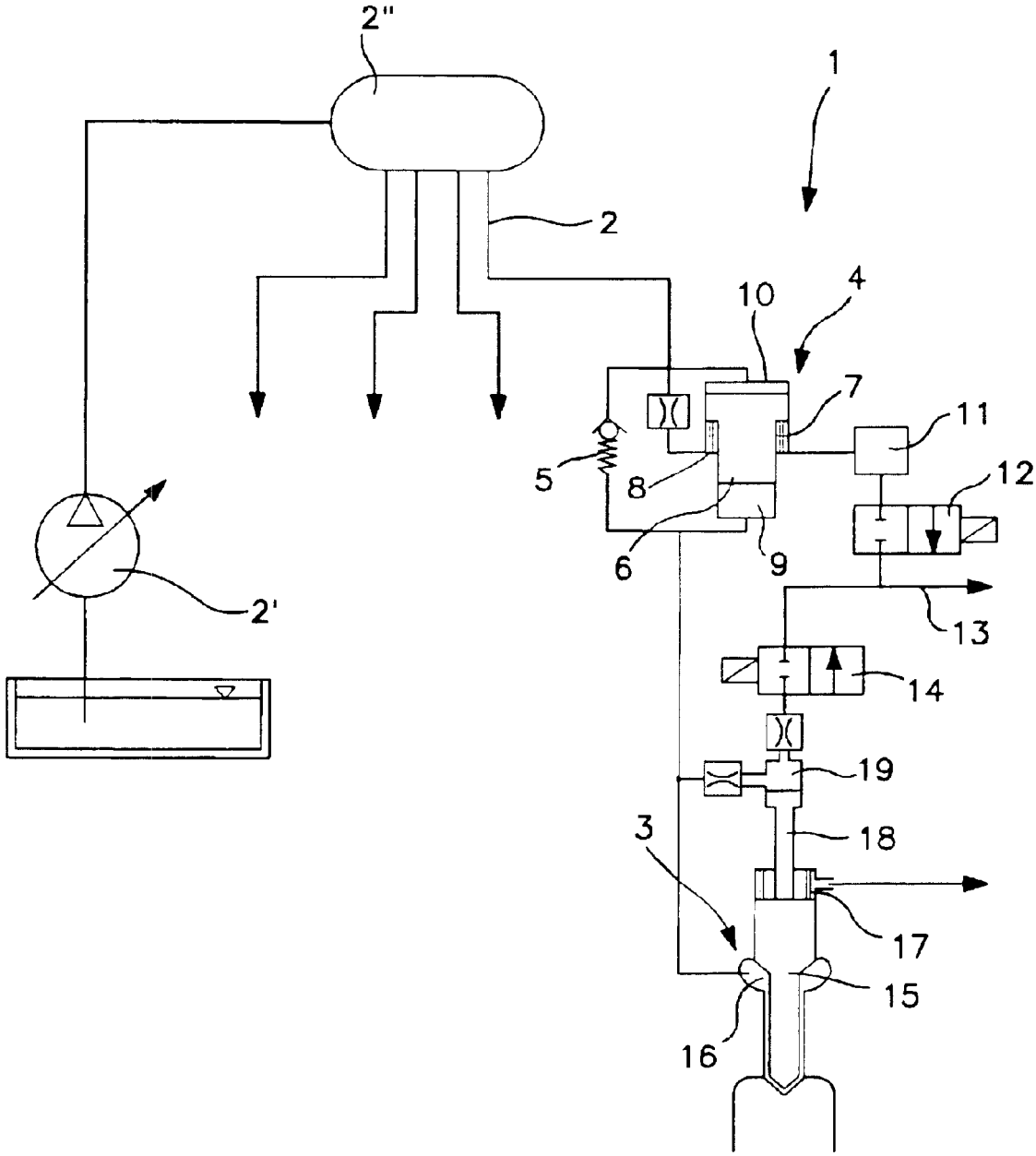
Fig. 3 PRIOR ART
FIG. 3 is a stroke-controlled fuel injection system with a pressure booster of the prior art.

In the known stroke-controlled fuel injection system 1 shown in FIG. 3, a quantity-regulated fuel pump 2' pumps fuel from a tank via a supply line into a central common rail 2", from which a plurality of pressure lines 2 corresponding to the number of individual cylinders lead to the individual injectors 3 (injection devices) protruding one into each combustion chamber of the engine to be supplied. In FIG. 1, only one of the injectors 3 is shown. With the aid of the fuel pump 2', a first system pressure is generated and stored in the common rail 2". This first system pressure is used for preinjection and, as needed, for postinjection (HC enrichment for the sake of exhaust gas posttreatment or soot reduction) as well as to produce an injection course with a plateau (boot injection). For injecting fuel at a second, higher system pressure, each injector 3 is assigned a respective local pressure booster 4 with a check valve 5 and a displaceable piston 6. Such fuel injection systems are known for instance from DE-A1-19910970.

For controlling the pressure booster 4, the pressure in the differential chamber 7, embodied by a transition from a larger to a smaller piston cross section, is used. For refilling and deactivating the pressure booster, the differential chamber 7 is subjected to a supply pressure (rail pressure). Then the same pressure conditions (rail pressure) prevail at all the pressure faces of a piston 6. The piston 6 is in pressure equilibrium. By means of an additional spring 8, the piston 6 is pressed into its outset position. For activating the pressure booster 4, the differential chamber 7 is pressure-relieved, and the pressure booster 4 generates a pressure boost depending on the ratio of surface areas. With this type of control, restoring the pressure booster 4 and refilling a pressure chamber 9 do not require that a pressure booster chamber 10 on the low-pressure side be pressure-relieved. Then, given a small hydraulic step-up, depressurization losses can be sharply reduced.

For controlling the pressure booster 4, instead of a complicated 3/2-way valve, a throttle 11 and a simple 2/2-way valve 12 can be used. The throttle 11 connects the differential chamber 7 with fuel, at supply pressure, from the common rail 2" to the valve 12. The 2/2-way valve 12 connects the differential chamber 7 to a leakage line 13. The throttle 11 should be designed to be as small as possible, yet still large enough that the piston 6 returns to its outset position between injection cycles. A guide leakage of the piston 6 can also be used as a throttle. With the 2/2-way valve 12 closed, no leakage in the guides of the piston 6 occurs, because the differential chamber 7 is subjected to pressure. The throttle can also be integrated with the piston.

If the 2/2-way valves 12 and 14 are closed, then the injector 3 is at the pressure of the common rail 2". The pressure booster 4 is in its outset position. Now, by means of the valve 14, an injection at rail pressure can occur. If an injection at higher pressure is desired, then the 2/2-way valve 12 is triggered (opened), and a pressure boost is thus attained.

The injection is effected via fuel metering with the aid of a nozzle needle 15, which is axially displaceable in a guide bore, and which has a conical valve sealing face on one end and with this face it cooperates with a valve seat face on the injector housing of the injector 3. At the valve seat face of the injector housing, injection openings are provided. Inside a nozzle chamber 16, a pressure face pointing in the opening direction of the nozzle needle 15 is exposed to the pressure prevailing there, which is delivered to the nozzle chamber 16 via a pressure line. Coaxially to a valve spring 17, a thrust piece 18, which with its face end remote from the valve sealing face defines a control chamber 19, also engages the nozzle needle 15. The control chamber 19 has an inlet with a first throttle, from the fuel pressure connection direction, and an outlet to the leakage line 13 that is controlled by the 2/2-way valve 14.

Fuel at the first or second system pressure constantly fills the nozzle chamber 16 and the control chamber 19. Upon actuation (opening) of the 2/2-way valve 14, the pressure in the control chamber 19 can be reduced, so that as a consequence, the pressure force in the nozzle chamber 16 acting on the nozzle needle 15 in the opening direction exceeds the pressure force acting on the nozzle needle 15 in the closing direction. The valve sealing face lifts from the valve seat face, and fuel is injected. The operation of pressure relief of the control chamber 19 and thus the control of the stroke of the nozzle needle 15 can be varied by way of the dimensioning of the throttles.

The end of the injection is initiated by re-actuating (closing) the 2/2-way valve 14, which disconnects the control chamber 19 from the leakage line 13 again, so that in the control chamber 19 a pressure again builds up that can move the thrust piece 18 in the closing direction.

Figure 2:
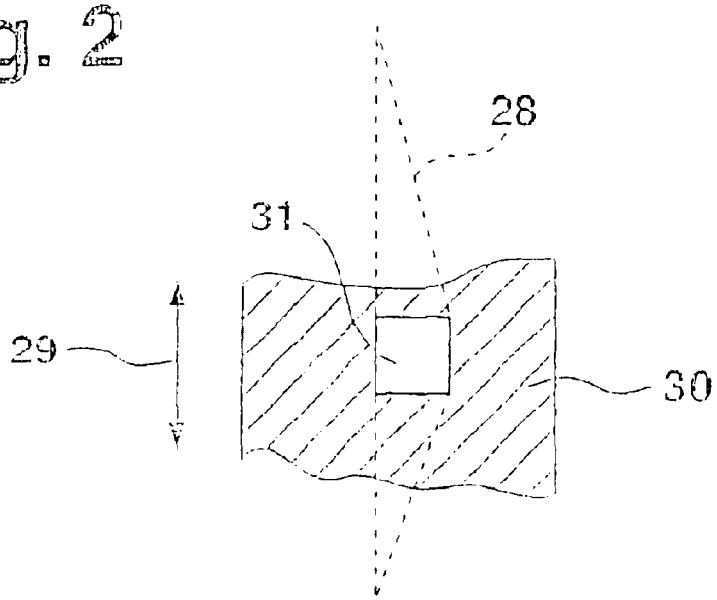
FIG. 2 is a second continuously variable change in cross section of the inlet to or outlet from a chamber of a pressure booster in a fuel injection system.

In FIGS. 1 and 2, the inlet to the pressure booster chamber 10 on the low-pressure side and/or the outlet from the differential chamber 7 (see FIG. 1) are provided with a continuous cross-sectional enlargement. A shallow pressure increase without interfering pressure fluctuations can be achieved. In FIG. 1, by the direction of motion 23 of a piston 24 (longitudinal direction of the opening and of the piston), depending on the position of the piston 24, only a partial area 25 of a slotlike opening 26 is uncovered as far as a control edge 24', while a partial area 27 of the opening 26 is covered. The opening 26 in the wall face of a pressure booster chamber (differential chamber or low-pressure chamber) establishes the communication of the differential chamber 7 (see FIG. 1) with the leakage line, or the communication of the pressure booster chamber 10 on the low-pressure side with the pressure line 2 (see FIG. 1), and is closable by the piston. As the piston stroke increases, a larger inlet or outlet cross section is uncovered. In FIG. 2, a slotlike opening 28 in the wall face of a pressure booster chamber has a cross-sectional area that is variable in the direction of motion 29 of the piston 30. The piston 30 itself has a recess 31, which establishes the continuous communication of the differential chamber 7 (see FIG. 1) with the leakage line, or the communication between the low-pressure chamber 10 and the pressure line 2. The recess 31 forms a kind of control window that slides along the slot 28.

Alternatively, the slotlike opening 28 can be embodied in the piston, and the control edge 24' or a recess 31 can be embodied in the wall face.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system (1) having a pressure booster (4), which booster has a displaceable piston (6; 24; 30) that can be subjected to pressure via a pressure booster chamber (10) on the low-pressure side, for compressing the fuel to be delivered to an injector (3) in a pressure booster chamber (9) on the high-pressure side, the stroke of the piston (6; 24; 30) being controllable essentially by the pressure in a differential chamber (7) of the pressure booster (4) and is used to influence the fuel pressure delivered to the injector (3), the improvement comprising means (24, 25; 28, 31) for continuously variable enlargement of the inlet cross section to the pressure booster chamber on the low-pressure side of the pressure booster (4) or of the outlet cross section from the differential chamber (7) of the pressure booster (4).

2. The fuel injection system of claim 1, wherein said means are embodied by a slotlike opening (26; 28) between one chamber (7, 10) of the pressure booster (4) and a supply line and by the piston (24; 30) that closes or opens the opening (26; 28).

3. The fuel injection system of claim 2, wherein the piston (24) comprises a control edge (24'), up to which the opening (26) is opened.

4. The fuel injection system of claim 2, wherein the piston (30) comprises a recess (31), which can be disposed above the opening (28) and defines an opened region of the opening (28).

* * * * *